US008076621B2

(12) United States Patent
Rastegar et al.

(10) Patent No.: US 8,076,621 B2
(45) Date of Patent: Dec. 13, 2011

(54) INTEGRATED REFERENCE SOURCE AND TARGET DESIGNATOR SYSTEM FOR HIGH-PRECISION GUIDANCE OF GUIDED MUNITIONS

(75) Inventors: Jahangir S. Rastegar, Stony Brook, NY (US); Thomas Spinelli, Northport, NY (US)

(73) Assignee: Omnitek Partners LLC, Ronkonkoma, NY (US)

( * ) Notice: Subject to any disclaimer, the term of this patent is extended or adjusted under 35 U.S.C. 154(b) by 192 days.

(21) Appl. No.: 12/550,399

(22) Filed: Aug. 30, 2009

(65) Prior Publication Data

US 2010/0059622 A1 Mar. 11, 2010

Related U.S. Application Data

(60) Provisional application No. 61/094,900, filed on Sep. 6, 2008.

(51) Int. Cl.
*F41G 7/00* (2006.01)
*F42B 15/01* (2006.01)
*F42B 15/00* (2006.01)

(52) U.S. Cl. ..... 244/3.1; 342/61; 342/62; 244/3.11; 244/3.14; 244/3.15; 244/3.19

(58) Field of Classification Search ..... 244/3.1–3.3; 89/1.11; 701/200, 207, 213; 343/700 R, 343/705, 708, 745, 746, 767, 771; 342/61, 342/62

See application file for complete search history.

(56) References Cited

U.S. PATENT DOCUMENTS

| | | | | |
|---|---|---|---|---|
| 3,045,596 | A * | 7/1962 | Rae | 244/3.11 |
| 4,347,996 | A * | 9/1982 | Grosso | 244/3.16 |
| 4,384,290 | A * | 5/1983 | Pierrot et al. | 244/3.19 |
| 6,098,547 | A * | 8/2000 | West | 244/3.14 |
| 6,307,514 | B1 * | 10/2001 | West | 343/705 |
| 6,473,041 | B2 * | 10/2002 | Koch et al. | 89/1.11 |
| 6,724,341 | B1 * | 4/2004 | Pereira et al. | 244/3.1 |
| 6,727,843 | B1 * | 4/2004 | Hansen | 244/3.1 |
| 6,919,846 | B2 * | 7/2005 | Koch et al. | 343/705 |
| 7,079,070 | B2 * | 7/2006 | Kongelbeck et al. | 244/3.1 |
| 7,339,537 | B2 * | 3/2008 | Hunsberger | 343/705 |
| 7,425,918 | B2 * | 9/2008 | Rastegar et al. | 244/3.1 |

* cited by examiner

*Primary Examiner* — Bernarr Gregory

(57) ABSTRACT

A method for guiding a moving object to a target. The method comprising: transmitting a signal from one or more illuminating sources defined in a reference coordinate system; receiving the signal at three or more cavity waveguides disposed on the moving object; using one or more forward observers to determine the position of the target; fixing the one or more illuminating sources to the one or more forward observers; determining a position and/or orientation of the object in the reference coordinate system based on a strength of the signal received in the three or more cavity waveguides; and guiding the moving object to the target based on the determined position and/or orientation.

5 Claims, 2 Drawing Sheets

INTEGRATED REFERENCE SOURCE AND TARGET DESIGNATOR SYSTEM FOR HIGH-PRECISION GUIDANCE OF GUIDED MUNITIONS

CROSS-REFERENCE TO RELATED APPLICATIONS

This application claims benefit to U.S. Provisional Application No. 61/094,900 filed on Sep. 6, 2008, the entire contents of which is incorporated herein by reference. This application is related to U.S. Pat. Nos. 6,724,341 and 7,193,556; U.S. Patent Application Publication No. 2007/0001051 and U.S. patent application Ser. Nos. 11/888,797 filed on Aug. 2, 2007 and 12/191,295 filed on Aug. 13, 2008, the entire contents of each of which is incorporated herein by reference.

BACKGROUND OF THE INVENTION

1. Field of the Invention

The present invention relates generally to reference sources and target designator systems, and more particularly, to integrated reference source and target designator systems for high-precision guidance of guided munitions.

2. Prior Art

In general, a human or machine (such as an "Unmanned Aerial Vehicle" (UAV), or an "Unmanned Ground Vehicle" (UGV) or a manned aerial or ground vehicle, or the like) is used to identify a target. Some means (e.g., one or more of the systems and devices such as "Global Positioning System" GPS, range finders, inertial devices, etc.) are then used to determine the position of the target and other relevant target indication information. Hereinafter, the above human or machine that is used to determine the position of the target is referred to generally as the "forward observer".

In general, the position of the target is determined by the "forward observer" and is indicated relative to the earth. The "forward observer" must also determine its own position relative to the earth. The weapon platform that is to engage the target must also know its own position relative to the earth. The target position and other information that is acquired by the "forward observer" is then passed to the engaging weapon platform fire controller (usually a computer), which would then perform proper computations and pass target position and other guidance and control information to the guided munitions that is to be launched against the designated target. Once launched, the guided munitions will use the target position information (and sometimes target position updates when it is available) to guide itself to the designated target position. Near the target, guided munitions may, when equipped with some type of homing sensors, also use the latter sensors to guide them to the target.

As indicated above, in most current munitions guidance and control systems, the position of the target is determined by the forward observer relative to the earth, i.e., the earth is considered to be the reference system in which the position of the target, the weapon platform, and the forward observer is defined. In addition, the guided munitions, such as a projectile fired from a gun or a mortar shell, monitors its position relative to the same earth based (fixed) position reference system. There is, however, a positioning error relative to each one of the above four position measurements relative to the earth fixed position reference system. As a result, the four position error measurements add up to make up the amount of positioning error that the guided munitions will have relative to the target that it is desired to intercept, leading to a significant degradation of the precision with which a target could be intercepted.

In general, the only method available for increasing the precision with which guided munitions can be guided to intercept the target is by providing some type of homing device. Such homing systems may, for example, include target seekers such as heat seeking sensors or various guidance systems utilizing laser designators, etc. Such homing systems usually require sophisticated sensory devices that occupy relatively large spaces onboard and require relatively high onboard power to operate, which make them unsuitable for many munitions applications, particularly gun-fired munitions (particularly small and medium caliber munitions) and mortars. In addition, homing systems using various target designators such as laser target designator generally requires a forward target observer, usually a human, to designate the target, which is also not a desirable solution.

A need therefore exists for a method and apparatus that can be used to significantly increase the precision with which a target position can be provided to guide guided munitions without requiring aforementioned homing systems or the like seekers.

An object of the present invention is to provide such a method and apparatus that can be used in munitions, particularly in gun-fired munitions and mortars, to provide significantly higher precision with which the position of the target is provided to munitions for guidance to intercept a designated target.

Another object of the present invention is to provide a method and apparatus that provides higher target position precision to guided munitions without requiring onboard seekers.

Another object of the present invention is to provide a method and apparatus that provides higher target position precision to guided munitions using the aforementioned polarized RF position and orientation sensors and polarized RF sources such that not only the position of the target becomes known to guided munitions during their flights but information is also provided to the guided munitions as to their orientation relative to the target. The latter orientation information is essential for munitions guidance and control, since by knowing its orientation relative to the target at all times, the guided munitions can perform its guidance maneuvers with minimal control actuation efforts, thereby requiring smaller actuation devices and less power for guidance and control. As a result, less volume will need to be occupied by the latter components, thereby making it possible to provide guidance and control components to munitions without degrading their effectiveness, particularly for smaller caliber munitions.

SUMMARY OF THE INVENTION

Accordingly, a method for guiding a moving object to a target is provided. The method comprising: transmitting a signal from one or more illuminating sources defined in a reference coordinate system; receiving the signal at three or more cavity waveguides disposed on the moving object; using one or more forward observers to determine the position of the target; fixing the one or more illuminating sources to the one or more forward observers; determining a position and/or orientation of the object in the reference coordinate system based on a strength of the signal received in the three or more cavity waveguides; and guiding the moving object to the target based on the determined position and/or orientation.

The one or more illuminating sources can comprise two or more illuminating sources and the one or more forward observers can comprise two or more forward observers, wherein at least two of the two or more illuminating sources are fixed to at least two of the two or more forward observers.

The one or more illuminating sources can comprise three or more illuminating sources and the one or more forward observers can comprise three or more forward observers, wherein at least three of the three or more illuminating sources are fixed to at least three of the three or more forward observers.

The method can further comprise providing position information from a GPS device to at least one or the one or more illuminating sources the one or more forward observers and the moving object, wherein the guiding is also determined based on the position information.

The method can further comprise providing position and/or orientation information from an inertial devices on board the moving object, wherein the guiding is also determined based on the position and/or orientation information

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

The polarized Radio Frequency (RF) reference sources and geometrical cavities as described in U.S. Pat. Nos. 6,724,341 and 7,193,556 and U.S. Patent Application Publication No. 2007/0001051, are hereinafter referred to as "polarized RF position and angular orientation sensors", and "scanning polarized RF reference sources" described in the U.S. patent application Ser. Nos. 11/888,797 filed on Aug. 2, 2007 and 12/191,295 filed on Aug. 13, 2008 and hereinafter are referred to as "RF reference sources" are used to form an integrated target designation and reference source system for high precision guidance of guided munitions towards its target.

The aforementioned "polarized RF position and angular orientation sensors" and "polarized RF reference sources" (such as the aforementioned scanning type of polarized RF reference sources) are used to form a integrated target designation and reference source system for high precision guidance of guided munitions towards its target.

Figure 1:
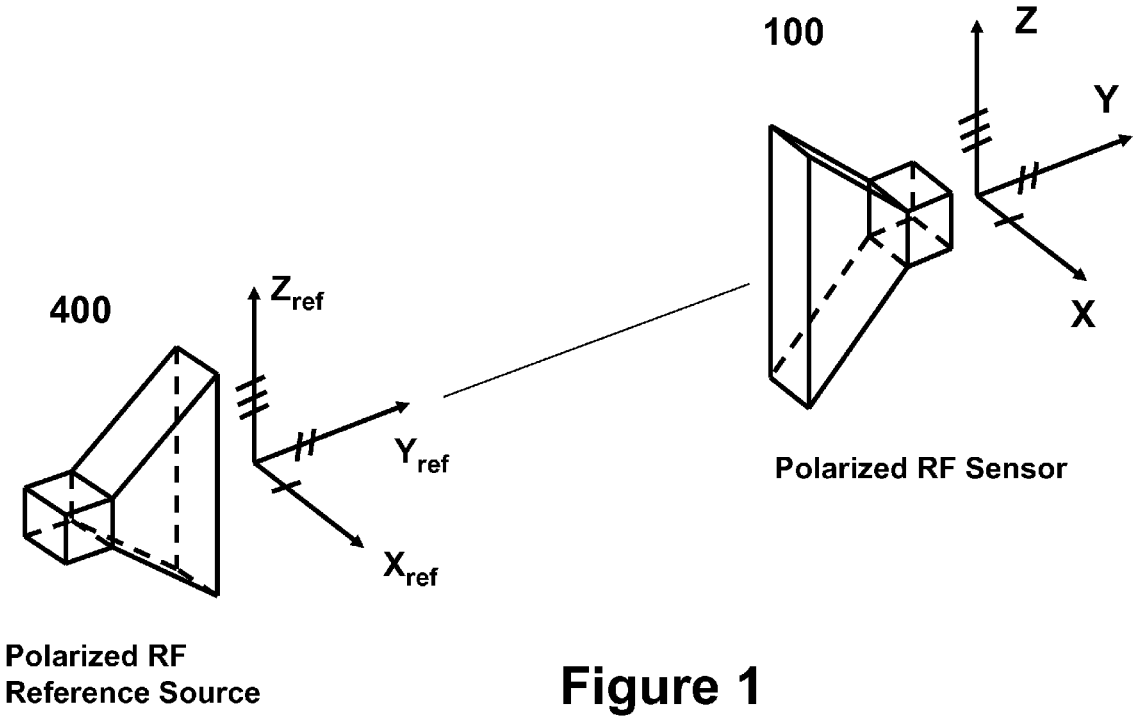
FIG. 1 illustrates an autonomous onboard absolute position and orientation measurement system (sensor) illustrating a polarized RF cavity sensor and a polarized RF reference source.

For example, FIG. 1 illustrates a polarized RF position and angular orientation sensor 100 considered to be embedded in the moving object (in this case a guided munitions in flight) and an RF polarized reference source 400. Although one of each is illustrated in FIG. 1, two or more are utilized. The position and orientation of the polarized RF reference sources 400 is considered to be known in the Cartesian coordinate system $X_{ref}Y_{ref}Z_{ref}$, which can be fixed to at least one of the polarized RF reference sources 400. The Cartesian coordinate system XYZ is considered to be fixed to the moving object (in this case a guided munitions in flight). The position and orientation of the polarized RF position and orientation sensors 100 are therefore known in the Cartesian XYZ coordinate system.

As described in the aforementioned U.S. Pat. Nos. 6,724,341 and 7,193,556 and U.S. Patent Application Publication No. 2007/0001051, by positioning at least three such polarized RF position and orientation sensors 100 on a first object and three such polarized RF reference sources 400 on a second object (forming a reference coordinate system $X_{ref}Y_{ref}Z_{ref}$), the full position and orientation of the first object can be determined relative to the second object, i.e., the position and orientation of the first object can be described fully in the reference coordinate system $X_{ref}Y_{ref}Z_{ref}$.

Figure 2:
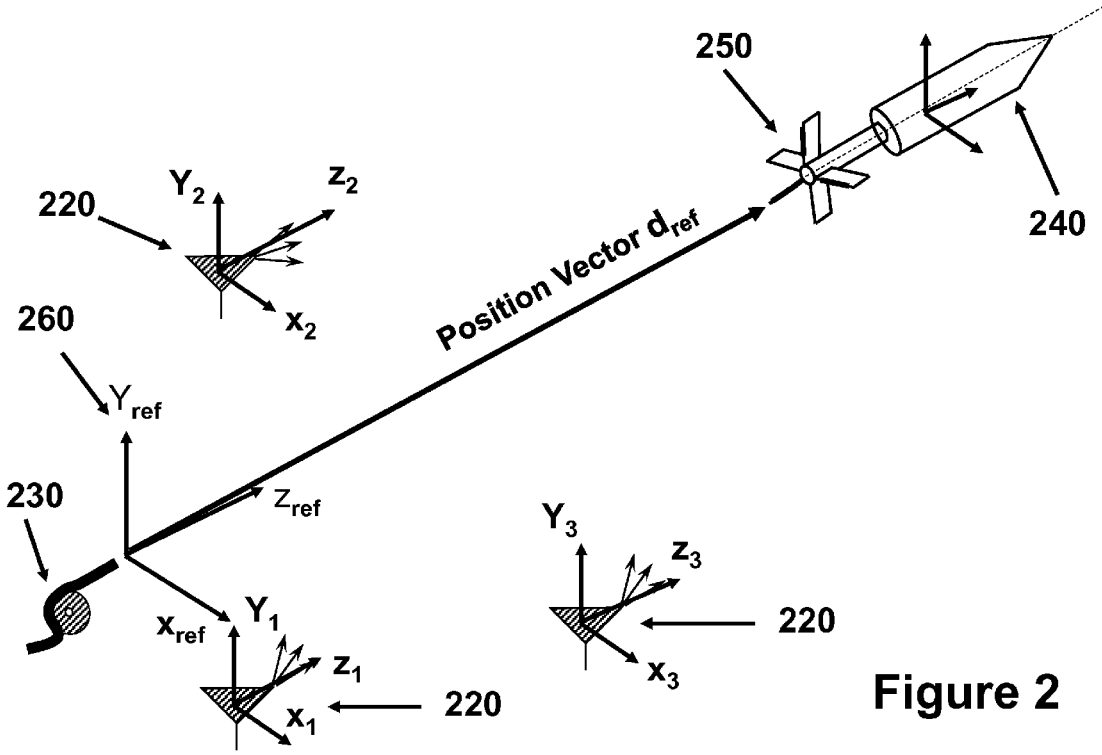
FIG. 2 illustrates an embodiment of an autonomous onboard absolute position and orientation measurement system, illustrating a plurality of polarized RF reference sources, shown surrounding a first object (in this case the fixed gun emplacement), to provide temporally synchronized, pulsed or continuous polarized RF reference signals to illuminate a second object (in this case a munitions in flight), on which a plurality of polarized RF cavity sensors are embedded (fixed) for providing on-board information about the position and orientation of the second object (munitions in flight) relative to the first object (the fixed gun).

FIG. 2 illustrates a basic method of using the aforementioned polarized RF reference source and polarized RF cavity sensors for onboard measurement of full position and angular orientation of one object relative to another object. In this method, three or more of the polarized RF reference sources 220, which can be pulsed, provides reference signals, that can be temporally synchronized, that illuminate an object (in this case a projectile such as a munitions 240). A minimum of three polarized RF reference sources 220 is required though a greater number increases the accuracy of the onboard position and orientation calculations. A reference coordinate system (in this case a Cartesian coordinate system $X_{ref}Y_{ref}Z_{ref}$, indicated as 260 in FIG. 2) can be used, relative to which the position of each polarized RF reference source 220 and the position and orientation of the first object (in this case the gun 230) is known. Three or more polarized RF cavity sensors 250 are embedded in the second object (in this case the projectile 240). The full position and orientation of the second object (the projectile 240) can then be determined onboard the second object 240 relative to the first object (in this case the gun 230). That is, the full position and orientation of the second object 240 (in this case the projectile 240) can be determined onboard the second object 240 in the Cartesian coordinate system $X_{ref}Y_{ref}Z_{ref}$ as described in the aforementioned patents and patent application.

The Cartesian coordinate system $X_{ref}Y_{ref}Z_{ref}$ may be fixed to the first object (in this case the gun 230) as shown in FIG. 2, or in certain cases it may be preferable that it is not fixed to the first object 230 but be fixed to the earth, in which case the first object is essentially the earth.

When the above polarized RF reference sources and onboard polarized RF cavity sensors are used to guide a projectile 240 to intercept a target (the position of which is known in the Cartesian coordinate system $X_{ref}Y_{ref}Z_{ref}$), then the aforementioned first object is the Cartesian coordinate system $X_{ref}Y_{ref}Z_{ref}$ or whatever object (usually the earth) to which the Cartesian coordinate system is attached. In general, the reference Cartesian coordinate system $X_{ref}Y_{ref}Z_{ref}$ is considered fixed to the earth since as it was indicated previously, in most current munitions guidance and control systems, the position of the target is determined by a "forward observer" relative to the earth. It is noted that the "forward observer" may be a ground or airborne human observer, a UAV, a UGV, a satellite, or the like. In addition, the position of the weapon platform and the position of the guided munitions are also indicated relative to the earth, i.e., in the reference Cartesian coordinate system $X_{ref}Y_{ref}Z_{ref}$. During the flight, the guidance and control system onboard the munitions would then use the target position information and its own position measurement (both in the reference Cartesian coordinate system $X_{ref}Y_{ref}Z_{ref}$—in this case fixed to the earth) to navigate to intercept the target.

As was previously indicated, a first positioning error exists in the measurement of the position of the "forward observer" in the reference Cartesian coordinate system $X_{ref}Y_{ref}Z_{ref}$, in this case fixed to the earth. A second position error exists in the measurement of the position of the target in the reference Cartesian coordinate system $X_{ref}Y_{ref}Z_{ref}$. A third position error exists in the measurement of the position of the polarized RF reference sources in the reference Cartesian coordinate system $X_{ref}Y_{ref}Z_{ref}$. A fourth position error also exists in the measurement of the position of the munitions during the flight in the reference Cartesian coordinate system $X_{ref}Y_{ref}Z_{ref}$. All these four position measurement errors add up as the navigation and guidance and control system onboard munitions calculates its position relative to the target that it is attempting to intercept.

An objective of the present invention is to provide a method and means of significantly reducing the aforementioned amount of error between the actual position of the target and the target position calculated onboard munitions.

In a first embodiment, one of the polarized RF reference sources 220 is fixed to the "forward observer" (for example, to the UAV or UGV used to determine the position of the target or to the device used by a human forward observer to determine the position of the target). In general and for safety reasons, a UAV or UGV or other types of unmanned devices can be used for this purpose. By fixing one of the polarized RF reference sources 220 to the "forward observer", the position of the target in the reference Cartesian coordinate system $X_{ref}Y_{ref}Z_{ref}$ is measured in the coordinate system established by the polarized RF reference source 220 that is used together with at least two other polarized RF reference sources to establish the reference $X_{ref}Y_{ref}Z_{ref}$ Cartesian coordinate system itself. As a result;

1. The error in the measurement of the position of the polarized reference sources 220 relative to the earth (or any other object to which the reference Cartesian coordinate system $X_{ref}Y_{ref}Z_{ref}$ would otherwise be fixed to) is eliminated from the error between the actual position of the target and the target position calculated onboard munitions.
2. The error in the measurement of the position of the "forward observer" in the reference Cartesian coordinate system $X_{ref}Y_{ref}Z_{ref}$ is significantly reduced since the reference Cartesian coordinate system $X_{ref}Y_{ref}Z_{ref}$ is defined by the polarized RF reference sources 220, one of which is the polarized RF reference source 220 that is fixed to the "forward observer", thereby significantly reducing the error between the actual position of the target and the target position calculated onboard munitions.
3. The error in the measurement of the position of the target in the reference Cartesian coordinate system $X_{ref}Y_{ref}Z_{ref}$ is significantly reduced since the reference Cartesian coordinate system $X_{ref}Y_{ref}Z_{ref}$ is defined by the polarized RF reference sources 220, one of which is the polarized RF reference source 220 that is fixed to the "forward observer" which is used to measure the position of the target, thereby significantly reducing the error between the actual position of the target and the target position calculated onboard munitions.

As a result, the error between the actual position of the target and the target position calculated onboard munitions and used by the munitions guidance and control system to guide it to intercept the target is significantly reduced. As a result, the precision with which the target can be intercepted by the guided munitions is significantly increased.

It is also noted that another advantage of the above embodiment is that the position of the polarized RF reference sources 220 relative to the earth or the gun 230 does not need to be known. It is, however, more efficient and generally requires less munitions maneuvering if the position of the gun 230 relative to the reference Cartesian coordinate system $X_{ref}Y_{ref}Z_{ref}$, i.e., the polarized RF reference sources 220 is known, thereby allowing the fire control system of the gun 230 to fire the munitions towards the selected target as accurately as possible.

In a second embodiment, more than one "forward observers" are used, to each of which a polarized RF reference sources 220 is affixed. It is appreciated that any type of "forward observers" (for example, to the UAV or UGV or a human forward observer or the like) or their combinations may be employed for this purpose. In general and for safety reasons, however, it is preferable to use UAVs or UGVs or other types of unmanned devices for this purpose. By fixing more than one polarized RF reference sources 220 to more than one "forward observers", the position of the target in the reference Cartesian coordinate system $X_{ref}Y_{ref}Z_{ref}$ is measured more accurately in the coordinate system established by the said polarized RF reference sources 220 that together with the remaining polarized RF reference sources establish the reference $X_{ref}Y_{ref}Z_{ref}$ Cartesian coordinate system itself. As a result, the second and third position measurement errors enumerated above for the first embodiment of the present invention are significantly further reduced. As a result, the error between the actual position of the target and the target position calculated onboard munitions and used by the munitions guidance and control system to guide it to intercept the target is significantly further reduced. As a result, the precision with which the target can be intercepted by the guided munitions is significantly increased.

In a third embodiment, at least three "forward observers" are used, to each of which a polarized RF reference source 220 is affixed. In this embodiment all polarized RF reference sources used to establish the reference Cartesian coordinate system $X_{ref}Y_{ref}Z_{ref}$ are the above polarized RF reference sources 220 that are fixed to the "forward observers". It is appreciated that any type of "forward observers" (for example, to the UAV or UGV or a human forward observer or the like) or their combinations may be employed for this purpose. In general and for safety reasons, UAVs or UGVs or other types of unmanned devices can be used for this purpose. By fixing all the polarized RF reference sources 220 to the "forward observers", the position of the target in the reference Cartesian coordinate system $X_{ref}Y_{ref}Z_{ref}$ is measured very accurately in the coordinate system established by the polarized RF reference sources 220. In addition, the second and third position measurement errors enumerated above for the first embodiment are no longer important in the onboard munitions calculation of the error between the actual position of the target and the target position calculated onboard munitions and used by the munitions guidance and control system to guide it to intercept the target. In fact, the latter error is reduced to the level at which "forward observer" can measure the position of the target in the reference Cartesian coordinate system $X_{ref}Y_{ref}Z_{ref}$ and that the munitions can measure its own position in the reference Cartesian coordinate system $X_{ref}Y_{ref}Z_{ref}$. In fact, since the latter two position measurements are made in the same reference Cartesian coordinate system $X_{ref}Y_{ref}Z_{ref}$, this embodiment acts as a homing device that can be used to guide munitions to the designated target. As a result, the precision with which the target can be intercepted by the guided munitions is even further increased.

In a fourth embodiment, either one of the aforementioned embodiments are used together with a GPS device that whenever available would provide position information to the gun 230 and/or polarized RF reference sources 220, and/or the "forward observers", and/or to the munitions 240 (FIG. 2). This position information is mostly redundant and is used to increase the precision with which the aforementioned position information and thereby the error between the actual position of the target and the target position calculated onboard munitions and used by the munitions guidance and control system to guide it to intercept the target are calculated. As a result, the precision with which the target can be intercepted by the guided munitions is even further increased.

In a fifth embodiment, either one of the aforementioned embodiments is used together with onboard inertial sensors such as accelerometers and/or gyros to provide added position and/or orientation measurements, particularly at high rates for flight control. These inertial devices are periodically initialized by the onboard munitions measurements of its position and orientation by the onboard polarized RF sensors (the position initialization may also be complemented by the GPS when it is available) to correct for the accumulated errors in their measurements. The position and/or orientation information provided by the above inertial devices are mostly redundant and are used to increase the precision with which the aforementioned position and/or orientation information and thereby the error between the actual position of the target and the target position calculated onboard munitions and used by the munitions guidance and control system to guide it to intercept the target are calculated. As a result, the precision with which the target can be intercepted by the guided munitions is even further increased.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for guiding a moving object to a target, the method comprising:

transmitting a signal from one or more illuminating sources defined in a reference coordinate system;

receiving the signal at three or more cavity waveguides disposed on the moving object;

using one or more forward observers to determine the position of the target;

fixing the one or more illuminating sources to the one or more forward observers;

determining a position and/or orientation of the object in the reference coordinate system based on a strength of the signal received in the three or more cavity waveguides; and guiding the moving object to the target based on the determined position and/or orientation.

2. The method of claim 1, wherein the one or more illuminating sources comprises two or more illuminating sources and the one or more forward observers comprises two or more forward observers, wherein at least two of the two or more illuminating sources are fixed to at least two of the two or more forward observers.

3. The method of claim 1, wherein the one or more illuminating sources comprises three or more illuminating sources and the one or more forward observers comprises three or more forward observers, wherein at least three of the three or more illuminating sources are fixed to at least three of the three or more forward observers.

4. The method of claim 1 further comprising providing position information from a GPS device to at least one or the one or more illuminating sources the one or more forward observers and the moving object, wherein the guiding is also determined based on the position information.

5. The method of claim 1 further comprising providing position and/or orientation information from an inertial devices on board the moving object, wherein the guiding is also determined based on the position and/or orientation information.

* * * * *